United States Patent [19]

Kelly

[11] Patent Number: 4,955,337

[45] Date of Patent: Sep. 11, 1990

[54] HIGH COMPRESSION INTERNAL COMBUSTION ENGINE

[75] Inventor: Eudell L. Kelly, Columbus, Ind.

[73] Assignee: Cummins Engine Company, Inc., Columbus, Ind.

[21] Appl. No.: 455,493

[22] Filed: Dec. 18, 1989

[51] Int. Cl.[5] ..... F02F 1/00

[52] U.S. Cl. ..... 123/193 CH; 123/193 H

[58] Field of Search ..... 123/193 H, 193 CH, 193 C, 123/41.83, 41.84

[56] References Cited

U.S. PATENT DOCUMENTS

| | | | |
|---|---|---|---|
| 1,088,520 | 2/1914 | Black | 123/41.84 |
| 1,306,843 | 6/1919 | Wolgamott | 123/41.84 |
| 3,653,369 | 4/1972 | Fangman et al. | 123/193 CH |
| 4,494,491 | 1/1985 | Takada et al. | 123/193 CH |
| 4,524,732 | 6/1985 | Dworak et al. | 123/193 CH |

*Primary Examiner*—Andrew M. Dolinar
*Assistant Examiner*—M. Macy
*Attorney, Agent, or Firm*—Neuman, Williams, Anderson & Olson

[57] ABSTRACT

A high compression internal combustion engine is provided wherein corresponding ends of the cylinder liners mounted within cylinder bores formed in the engine block are secured to the cylinder head by a first set of fastening elements threaded into the corresponding ends so as to provide a seal between the head and each liner which is capable of withstanding the combustion pressures generated within each liner, when the engine is in operation. A second set of fastening elements, independent of the first set, secures the cylinder head to the engine block so as to provide a seal between complementary surfaces thereof which is capable of withstanding pressures generated by the circulating cooling medium during operation of the engine.

9 Claims, 1 Drawing Sheet

HIGH COMPRESSION INTERNAL COMBUSTION ENGINE

BACKGROUND OF THE INVENTION

In the operation of high compression internal combustion engines, various problems have existed in the past involving liner distortion and stress buildup within the block. These problems occur because of liner protrusion and the tightening force, which must be applied to the capscrews, securing the cylinder head to the block, in order to withstand the high combustion pressures generated within the liners.

Attempts have heretofore been made to minimize these problems by costly redesigning of various engine components and/or by the utilization of special, complex and costly gaskets. Servicing of such prior engines frequently would require an inordinate amount of time and effort, and the talents of a skilled mechanic.

SUMMARY OF THE INVENTION

Thus, an improved high compression internal combustion engine has been provided which effectively overcomes the aforementioned problems.

The improved high compression engine decreases oil consumption and blowby by reducing liner distortion through the utilization of two sets of capscrews or bolts. One set of such capscrews is provided for securing the cylinder liners to the cylinder head and thus, effectively seal against the pressures generated within the liners. The other set of capscrews is for securing the head to the block as well as provide an effective seal against the pressures generated by the cooling medium circulated through the engine. The tightening forces applied to the sets of capscrews may vary significantly and will depend upon the size and operating capabilities of the engine. The utilization of two sets of capscrews improves the sealing obtained within the engine with the result that better fuel efficiency and emission control are attained.

Further and additional advantages possessed by the improved high compression engine will become apparent from the description, accompanying drawings and appended claims.

In accordance with one embodiment, an improved, high compression internal combustion engine is provided which includes an engine block having formed therein a predetermined number of cylinder bores. Disposed within each bore is a cylinder liner having one end thereof proximate an exterior surface of the block. Overlying the exterior surface of the block is a cylinder head. A gasket is interposed the head and the exterior surface of the block. A first set of capscrews engages the cylinder head and secures the cylinder liners thereto. A second set of capscrews, independent of said first set, is provided for securing the cylinder head to the block. The tightening force applied to the first set of capscrews provides a seal against the pressures generated within the liner. The tightening force applied to the second set of capscrews effects securement of the head to the block and also provides a seal against the pressures generated within the engine by the circulating cooling medium.

DESCRIPTION OF THE INVENTION

For a more complete understanding of the invention reference is made to the drawings wherein.

Figure 1:
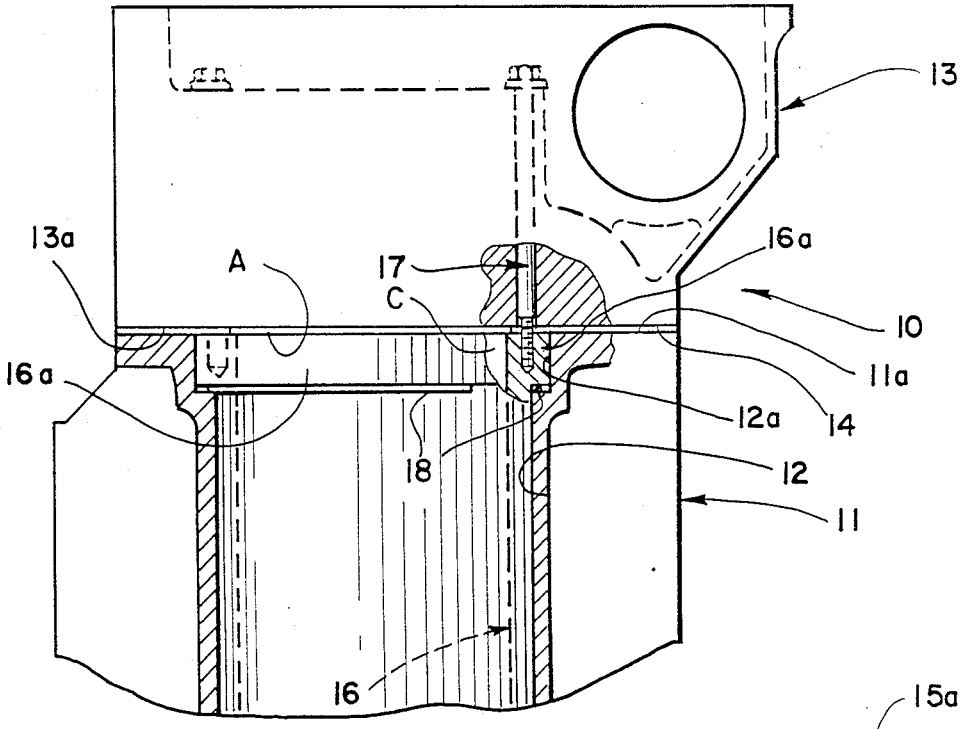
FIG. 1 is a fragmentary front elevational view, partially in vertical section, of one embodiment of the improved high compression internal combustion engine.

Referring now to the drawings and more particularly to FIG. 1, one embodiment 10 of the improved high compression internal combustion engine is shown which is suitable for use in heavy duty diesel trucks and the like. As illustrated, engine 10 includes a cylinder block 11 in which a predetermined number of cylinder bores 12 are formed. The number of bores will depend upon the power demands of the truck in which the engine is installed. The upper surface **11*a* of the block is machined and is adapted to have mounted thereon a cylinder head 13. Interposed the surface 11*a* and an adjacent surface 13*a* of the cylinder head 13 is a gasket 14**.

Figure 2:
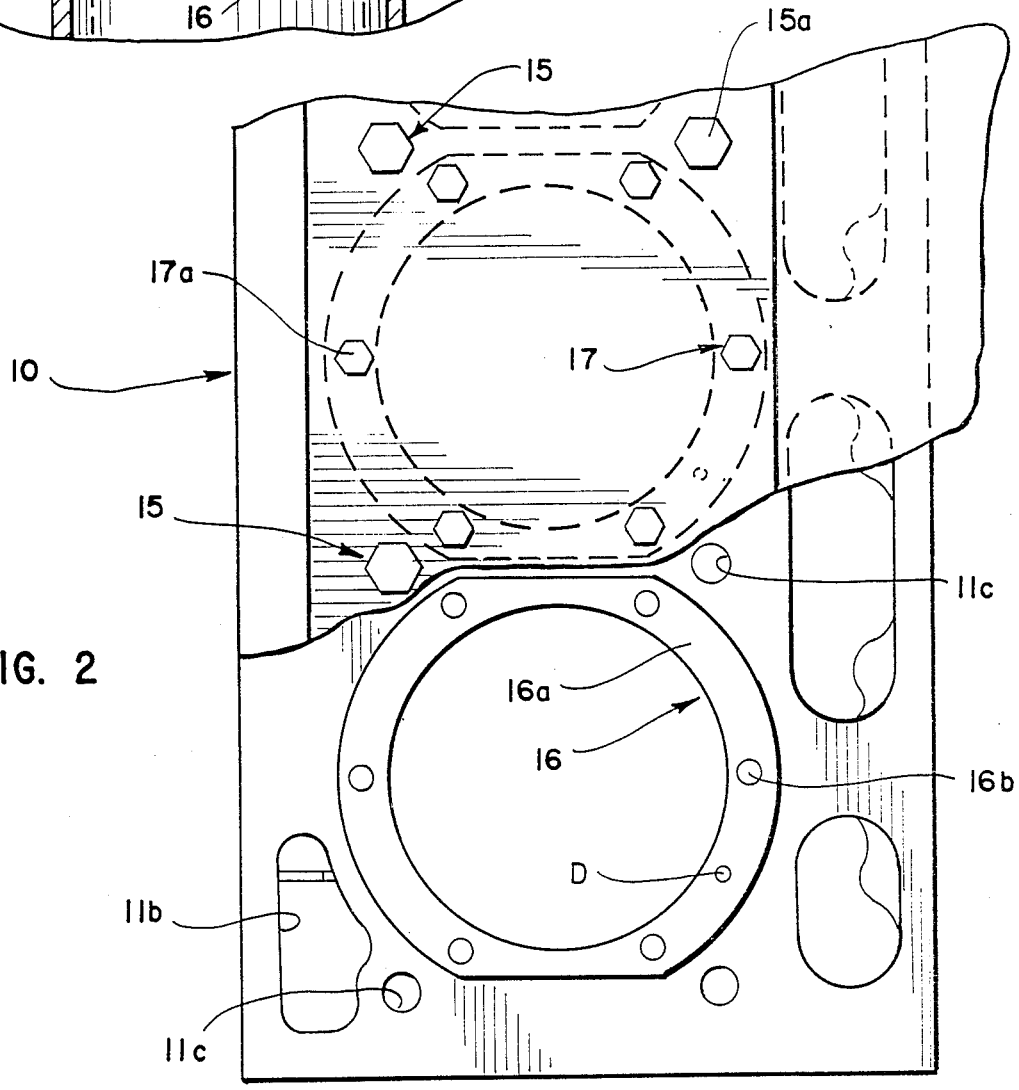
FIG. 2 is a top view of the engine of FIG. 1 with a portion of the cylinder head removed.

Besides the cylinder bores 12, the block 11 is provided with a plurality of passageways **11*b* through which a suitable cooling medium circulates when the engine is in operation. The passageways 11*b* are independent of the bores 12, but in proximity thereto. The cylinder head may be provided with corresponding passageways, not shown, which are in communication with the block passageways 11*b*. The block, as seen in FIG. 2 is provided with a plurality of internally threaded holes 11*c* which are adapted to accommodate a first set of capscrews 15. The capscrews 15 extend through suitable openings formed in the cylinder head into the corresponding holes 11*c*. Enlarged heads 15*a* formed on exposed ends of the capscrews are adapted to be engaged by a socket wrench, not shown, when tightening or loosening of the capscrews is required. The amount of force required to tighten the capscrews 15 must be such as to retain the head 13 and block 11 in assembled relation and provide a seal between the head and block which is capable of withstanding the pressure of the cooling medium circulating through the passageways 11*b***.

Mounted within each cylinder bore 12 formed within the block 11 is a cylinder liner 16 which preferably extends the full length of the bore. The liner is sized to accommodate a reciprocating piston head, not shown. The top surface of the piston head coacts with an area A of the adjacent surface **13*a*** of the head to form a combustion chamber C in which the atomized fuel introduced into the chamber is ignited during a predetermined segment of the piston head stroke.

As seen in FIG. 1, the upper end of each liner 16 is encompassed by an outwardly extending collar **16*a*. The corresponding upper end 12*a* of each cylinder bore is countersunk to accommodate the thickness and shape of the collar 16*a*. The width and thickness of collar 16*a* are such that symmetrically arranged threaded openings 16*b* are formed therein. The axis of each opening is transverse to the surface 11*a* of the block 11 and substantially parallel to the longitudinal axis of the liner. The exposed surface of each liner collar is substantially parallel with the head surface 13*a* aligned therewith. The collar openings 16*b* are adapted to accommodate the concealed ends of a second set of capscrews 17. Each capscrew 17 extends through a suitable opening formed in the cylinder head and has an exposed, enlarged head 17*a* which is adapted to be engaged by a socket wrench or the like when the capscrew 17 is to be tightened or loosened. By reason of the capscrews 17 being threaded into only the liner collars and not into the block itself, the torque applied to the capscrews 17**, when tightening same, must be such that the seal between the head and liners will readily withstand the high combustion pressures generated within the combustion chambers C without causing severe liner distortion. Furthermore, liner stops, normally incorporated in the block, can be eliminated thereby reducing significantly stresses developing within the block. The elimination of severe liner distortion effects reduction in fuel consumption and blowby thereby improving fuel efficiency and also results in more complete combustion of the fuel and thus, improved emission control.

Each liner collar 16*a* may be provided with a dowel D which facilitates alignment of the gasket 14 and cylinder head 13 with respect to the block surface 11*a*. A conventional o-ring 18 may be disposed within the countersunk portion 12*a* of the cylinder bore and beneath the liner collar 16*a*, see FIG. 1.

Thus, an improved high compression internal combustion engine has been described which eliminates severe liner distortion and as a consequence reduces fuel consumption, blowby and fuel emissions. Furthermore, top, mid or bottom liner stops within the cylinder bore are no longer required thus, reducing stress within the engine block. The elimination of the bottom liner stop in some engine designs increases the clearance between the piston rod and the block.

The shape, size and relative location of the liners and cylinder bores may vary from that shown and described without departing from the scope of the invention. The number, size and relative location of the sets of capscrews will depend upon the type, size and power demands required of the engine.

I claim:

1. A high compression internal combustion engine comprising an engine block having at least one cylinder bore formed therein, said bore having one end terminating at an exterior surface of said block; a cylinder liner disposed within the bore and having an end thereof proximate said block exterior surface; a cylinder head overlying said block exterior surface, said head having an exterior surface complementary to and in registry with said block surface; gasket means interposed between said complementary exterior surfaces; first fastening means engaging said head and the one end of said cylinder liner and securing in sealed relation said one end of said liner to said head surface upon a first predetermined external tightening force being applied to said first fastening means; and second fastening means engaging said head and said block and securing in sealed relation said complementary exterior surfaces together upon a second predetermined external tightening force being applied to said second fastening means.

2. The internal combustion engine of claim 1 wherein the first fastening means includes a first set of fastening elements arranged in annularly spaced relation about the one end of said cylinder liner.

3. The internal combustion engine of claim 2 wherein the first set of fastening elements are disposed in closer relation to a longitudinal axis of said liner than the second set fastening means.

4. The internal combustion engine of claim 1 wherein the tightening force applied to the first fastening means effects a seal which is adapted to withstand pressures generated within said cylinder liner during operation of the engine.

5. The internal combustion engine of claim 2 wherein the fastening means elements of the first set are symmetrically arranged about a longitudinal axis of the liner and spaced from and independent of said second fastening means.

6. A high compression internal combustion engine comprising an engine block having at least a pair of relatively spaced cylinder bores formed therein, said bores having corresponding ends thereof terminating at an exterior surface of said block; passageways formed in said block through which a cooling medium is adapted to circulate, said passageways being spaced from said cylinder bores, at least one end of each passageway terminating at said block exterior surface; a cylinder liner disposed within each bore, each liner having one end thereof disposed adjacent the block exterior surface; a cylinder head overlying said block exterior surface, said head having an exterior surface complementary to and in registry with said block surface; gasket means interposed between said complementary exterior surfaces; a first set of fastening elements engaging said head and said ends of said liners and securing in sealing relation the latter to said head exterior surface to withstand combustion pressures generated within the cylinder liners during operation of the engine, and a second set of fastening elements independent of said first set and engaging said head and said block and securing together in sealing relation the complementary surfaces thereof to withstand pressures generated within the passageways by the circulating cooling medium.

7. The internal combustion engine of claim 6 wherein the maximum combustion pressure generated within each cylinder liner is substantially greater than the maximum pressure generated within said passageways when the engine is in operation.

8. The internal combustion engine of claim 1 or 6 wherein the first and second sets of fastening elements comprise a plurality of capscrews, each having an exposed head.

9. The internal combustion engine of claim 8 wherein each capscrew of the first set has a concealed end threaded into a collar portion of said cylinder liner defining the liner one end.

* * * * *

UNITED STATES PATENT AND TRADEMARK OFFICE

CERTIFICATE OF CORRECTION

PATENT NO. : 4,955,337

DATED : September 11, 1990

INVENTOR(S) : Eudell L. Kelly

It is certified that error appears in the above-identified patent and that said Letters Patent is hereby corrected as shown below:

Column 4, line 20, "one" should be inserted before--ends--.

Column 4, line 33, before "ends" insert --liner one-- and delete "of said liners".

Signed and Sealed this

Seventh Day of January, 1992

*Attest:*

HARRY F. MANBECK, JR.

*Attesting Officer*

*Commissioner of Patents and Trademarks*